United States Patent [19]

Hufton

[11] 3,992,747

[45] Nov. 23, 1976

[54] CLEANING TOOL

[75] Inventor: Austen B. Hufton, Glen Ellyn, Ill.

[73] Assignee: Service Master Industries Inc., Downers Grove, Ill.

[22] Filed: Apr. 9, 1975

[21] Appl. No.: 566,253

[52] U.S. Cl. ..... 15/321; 15/322; 15/364; 15/369; 15/401

[51] Int. Cl.[2] ..... A47L 7/00

[58] Field of Search ..... 15/320, 321, 322, 393, 15/401, 364, 369

[56] References Cited

UNITED STATES PATENTS

| | | | |
|---|---|---|---|
| 965,315 | 7/1910 | Moorhead | 15/321 X |
| 2,177,987 | 10/1939 | Kelly | 15/321 X |
| 3,599,272 | 8/1971 | Merrick | 15/321 |

*Primary Examiner*—Christopher K. Moore
*Attorney, Agent, or Firm*—Allegretti, Newitt, Witcoff & McAndrews

[57] ABSTRACT

An improved tool is disclosed for cleaning hard surface floors. The tool includes a scrubbing block which is pivotally mounted on the lower end of a handle that may be manipulated by a person standing by the tool. A housing is mounted about the scrubbing block and is connected with the scrubbing block by leaf springs so as to permit the housing to "float" with respect to the scrubbing block. The housing includes a bottom surface and curved, generally transverse, front and rear channels that are disposed adjacent to the front and rear of the housing, that are open to the floor, and that are connected with a vacuum conduit. Squeegee blades are disposed in the channels and are carried therein by support members pivotally mounted on the housing. The support members include a plurality of depending feet which support the housing so that its bottom surface is above the floor to be cleaned. Links interconnect the ends of the support members whereby when the tool is moved in a forward direction, transverse to the channels, the lower edge of the squeegee blade in the front channel is disposed slightly above the floor while the lower edge of the squeegee blade in the rear channel is held in contact with the floor and whereby when the tool is moved in a rearward direction, transverse to the channels, the lower edge of the squeegee blade in the rear channel is disposed slightly above the floor while the lower edge of the squeegee blade in the front channel is held in contact with the floor.

20 Claims, 10 Drawing Figures

CLEANING TOOL

BACKGROUND AND SUMMARY OF THE INVENTION

The present invention relates to a cleaning tool, and more particularly, to an improved tool for cleaning a hard surface floor, such as a floor covered by linoleum, asphalt tile, and the like.

Hard surface floors are generally cleaned by applying a soap or detergent washing solution to the floor and then preferably removing the solution and the dirt from the floor. In the past, the application and removal of washing solution has been done by hand, using a hand brush, wet mop or the like. However, this hand application and removal of the washing solution tends to be a relatively time consuming, laborious task even when done by a person experienced inmaintenance work.

Moreover because of the extra time and effort involved, a washing solution is commonly not changed after each room or even after each particular area has been cleaned. Consequently, the cleaning solution tends to become contaminated with the dirt on the floors which have previously been cleaned. This contamination makes it difficult to maintain the cleaning "strength" of the washing solution and may present a serious problem in hospitals, health care facilities and the like.

It is the primary object of my present invention to provide an improved tool for cleaning hard surface floors. The novel tool of my present invention represents a significant improvement over the prior hand brush and wet mop techniques utilized to clean hard surface floors in that it permits the facile cleaning of hard surface floors with a minimum of time and labor. In this regard, tests have indicated that my improved tool can do the same job, from the standpoint of cleanliness, as a wet mop, while reducing the time required to do the job by ten to fifteen per cent. Moreover my improved tool does not reuse the washing solution, but rather continuously applies a fresh, controlled amount of solution to the floor to be cleaned. This eliminates contamination problems and since in addition, permits optimum strength washing solution to be continuously used without stripping wax from the floor.

More specifically, the improved tool of my present invention includes a housing and a scrubbing block which is pivotally connected to the lower end of a handle and which is adapted to have its bottom surface in contact with the floor to be cleaned. The handle is arranged so as to permit the tool to be easily manipulated by a person standing in an upright position. The scrubbing block has a scrubbing pad detachedly secured to its bottom surface and can be used to remove a spot of ground-in-dirt or the like from the floor by the person pressing down on the handle and rubbing the scrubbing back and forth on the dirty spot.

The housing is positioned about the scrubbing block and includes curved, transverse, front and rear channels which are formed in the housing adjacent to its front and rear ends, which are open to the floor and which are formed in the housing so that their ends are adjacent to each other. The front and rear channels are both communicated with a conduit connected with a vacuum source and carried in part by the handle. The vacuum is of sufficient strength so as to be able to suck up any accumulated liquid and small particles of dirt and the like which come within or beneath the channels.

A manifold is mounted on the housing and includes a plurality of nozzles that are utilized to spray washing solution onto the floor between the front and rear channels. The manifold is connected, via tubing carried in part by the handle, with a source of cleaning solution. A valve mounted on the handle permits the operator of the tool to control the rate of discharge of the cleaning solution through the nozzles.

A pair of support members is mounted in each of the channels so that their lower ends may pivot through an arc in the channel. The support members extend substantially from one end of their respective channel to the other, and have a plurality of feet which project below the lower surface of the housing and support the housing above the floor to be cleaned. Each of the pairs of support members carries a squeegee blade whose lower end is adapted to contact the floor. Links interconnect adjacent ends of the support members so that the support members and thus the squeegee blades pivotally move in concert or together within their respective channels. When the tool is pushed in a forward direction, generally transverse to the channels, the lower edge of the squeegee blade in the front channel is positioned slightly above the floor while the lower edge of the squeegee blade in the rear channel is held in contact with the floor surface. When the tool is moved in a rearward direction, generally transverse to the channels, the lower edge of the squeegee blade in the rear channel is positioned slightly above the floor while the lower edge of the squeegee blade in the forward channel is in contact with the floor. Thus liquid on the floor can pass beneath the squeegee blade in the leading channel of the tool but cannot pass beneath the squeegee blade in the trailing edge. This assures that the washing solution applied to the floor can be sucked up through the channels and into the vacuum conduit. These and other objects and advantages of the present invention will become apparent from the following description of the preferred embodiment of my invention which is described in connection with the accompanying drawings:

Figure 1:
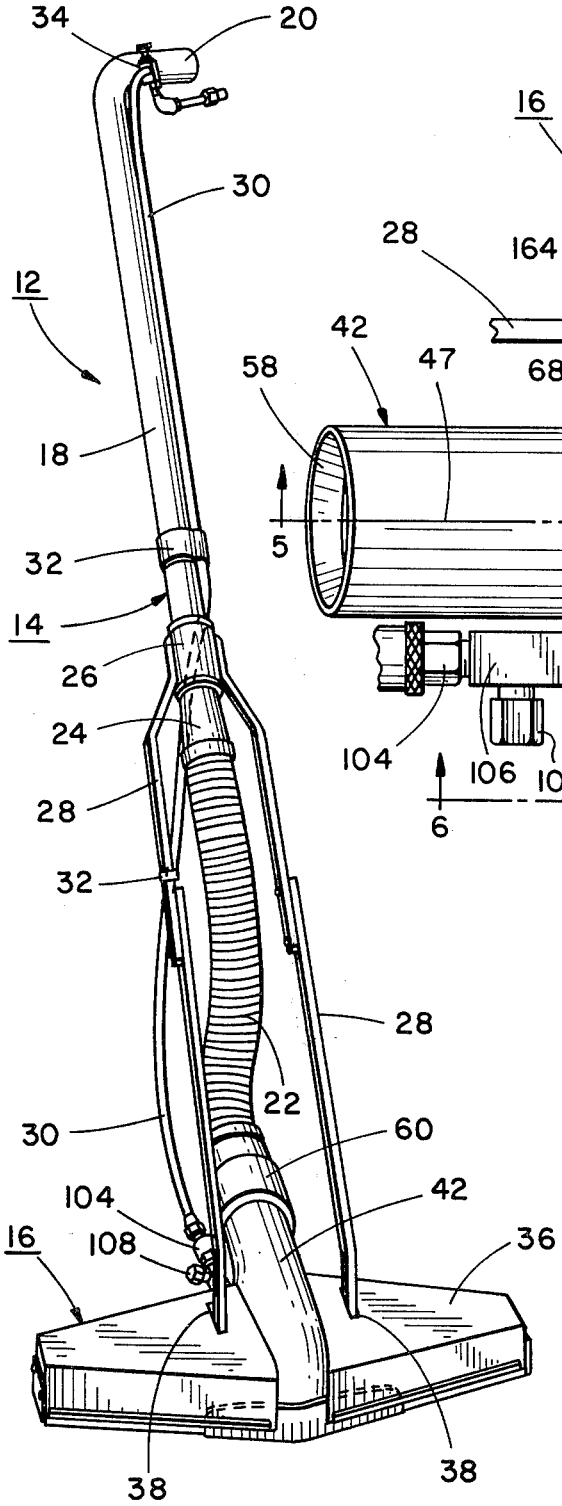
FIG. 1 is a perspective view of an improved tool embodying the principles of my invention.

Throughout the various figures of the drawings, the same reference numerals will be used to designate the same parts or components. Moreover, when the terms "right", "left", "right end", "left end", "front", "rear", "forward", "rearward", "top", and "bottom" are used herein, it should be understood that these terms have reference to the structure shown in the drawings as it would appear to a person viewing the drawings.

DESCRIPTION OF THE PREFERRED EMBODIMENT

Referring now to the drawings, an improved tool embodying the principles of my present invention is shown generally at 12 and comprises a handle 14 and a head 16. The handle 14 is connected with the head 16 as hereinafter described and includes a rigid metal tube 18 whose upper end 20 is adapted to be connected, by means of a flexible tubing not shown, with a source of vacuum. The metal tube 18 functions both as a vacuum conduit and as a means by which the person using the tool 12 may manipulate the head 16.

A flexible tube 22 is connected at one end with the lower end 24 of the metal tube 18. The other end of the flexible tube 22 is connected with the head 16 of the tool as hereinafter described.

A collar 26 is secured to the metal tube 18 adjacent its lower end 24. A pair of arms 28 have their upper ends secured to the outer surface of the collar 26 at diametrically opposed points and extend downwardly from the metal tube 18 in a plane which includes the longitudinal axis of the tube.

A relatively small diameter tubing 30, carried in part by the handle 14, extends from the upper end 20 of the handle to the head 16. Clips 32 may be used to secure the tubing 30 to the metal tube 18 and to one of the arms 28. The upper end of the tubing 30 is connected with a tank or other source of washing solution, not shown, which may, for example, be a water-detergent solution or a water-soap solution. A valve 34 is mounted on the upper end 20 of the metal tube 18 and controls the flow of cleaning solution through the tubing 30. Preferably the solution is maintained under pressure in the tubing 30 while the tool 12 is being used.

As best shown in FIG. 1, a detachable shroud 36 fits on and covers the upper portion of the head 16. Apertures 38 are cut in the shroud 36 to allow the lower ends of the arms 28 to pass therethru.

Referring now particularly to FIGS. 2–6, the head 16 comprises a metal housing 40 including an integral central suction tube 42, a front channel member 44, and a rear channel member 46. Front and rear channel members 44 and 46 include front and rear channels 48 and 50, respectively. Each of the channels 48 and 50 has a generally inverted U-shaped, transverse cross-section and are open to the floor to be cleaned along their lower edges.

Figure 2:
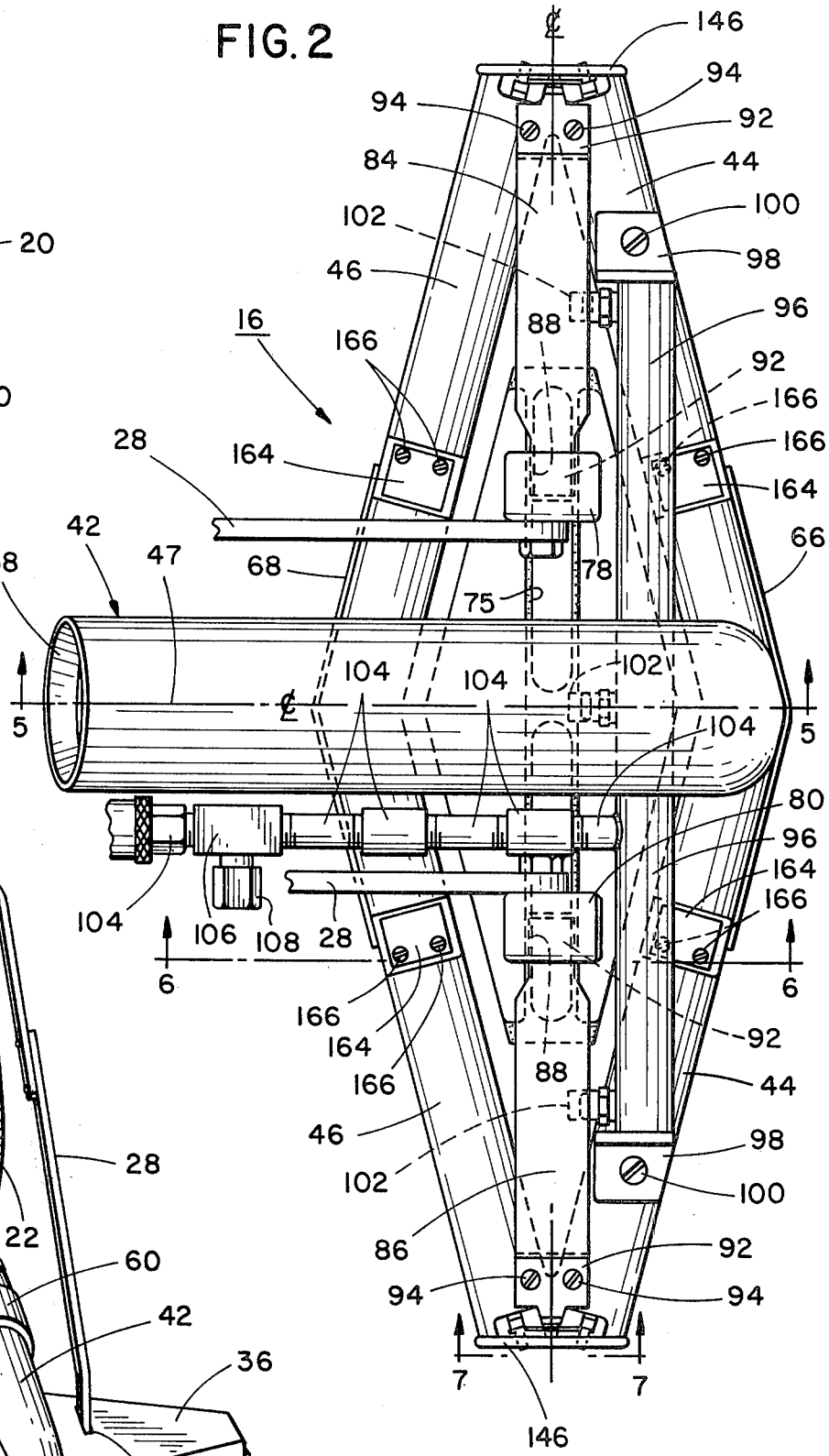
FIG. 2 is a top plan view of the housing and scrubbing block of the improved tool shown in FIG. 1.
Figure 3:
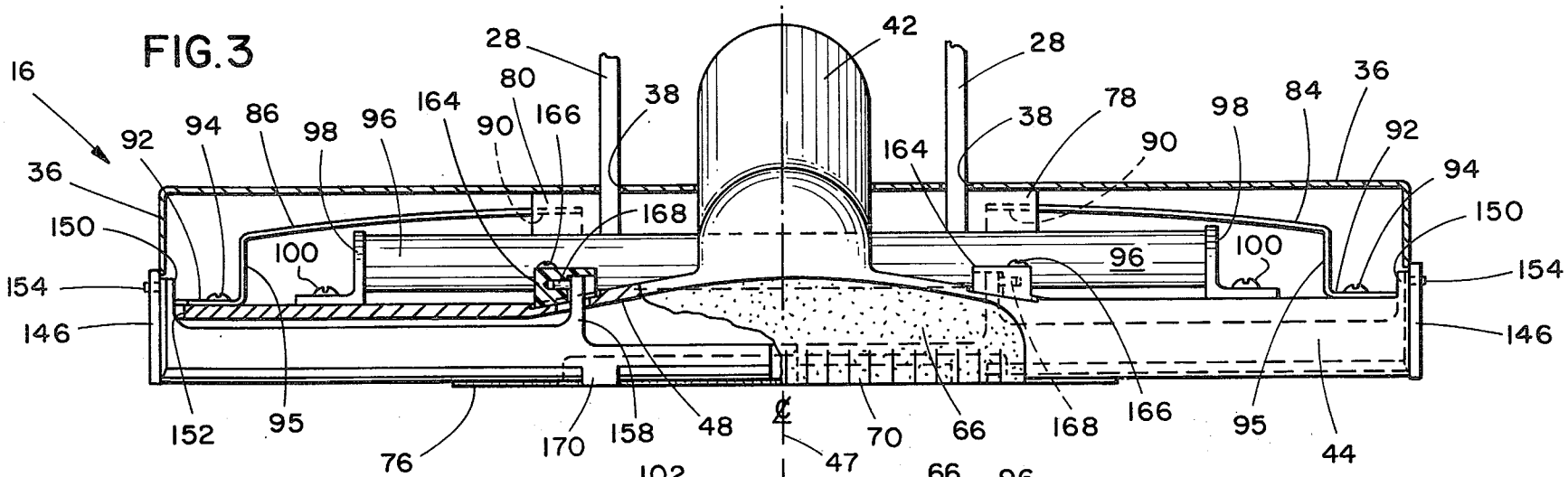
FIG. 3 is a front plan view of the head of the improved tool shown in FIG. 1.
Figure 4:
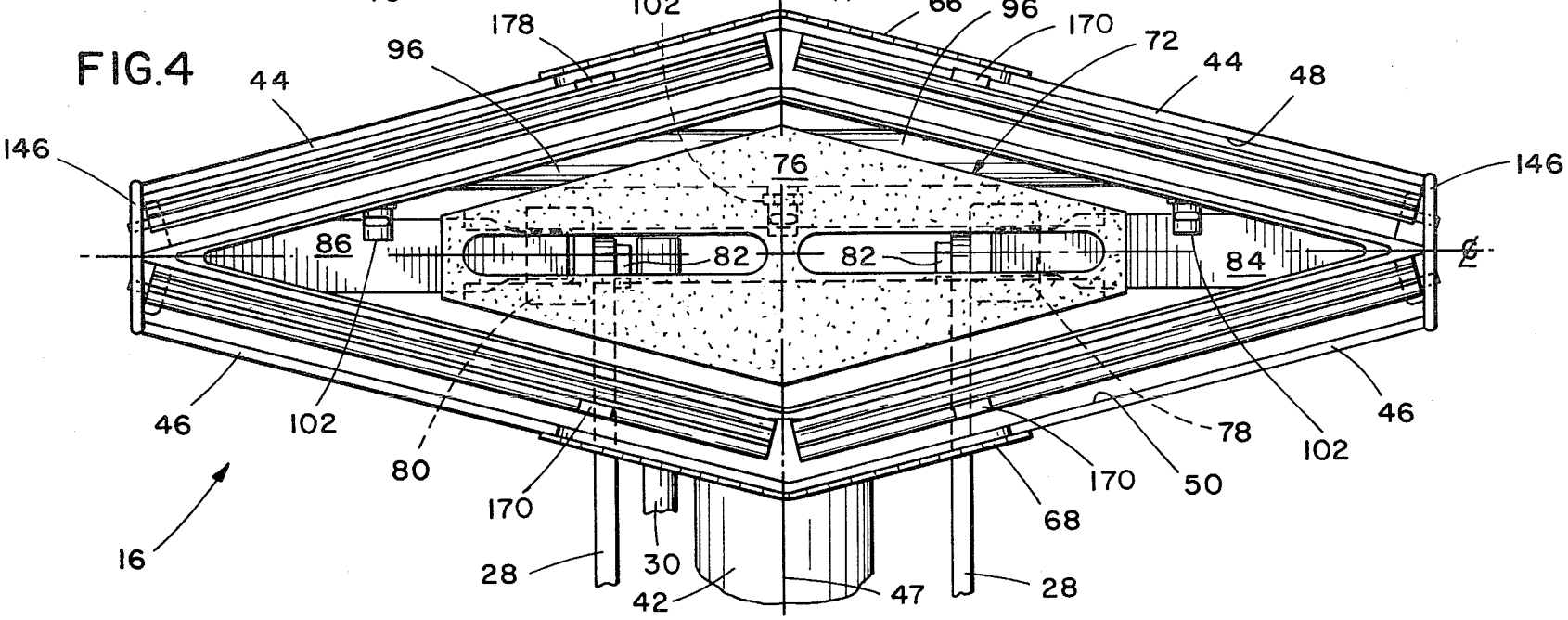
FIG. 4 is a bottom view of the head of the improved tool shown in FIG. 1.

As best shown in FIG. 2, the front and rear channel members 44 and 46, and the channels 48 and 50 therein, are symmetrically curved about a transverse plane perpendicular to the longitudinal central (front to rear) axis 47 of the head 16. In this regard, the center(s) of curvature of the front channel 48 lies to the rear of this plane and the center(s) of curvature of the rear channel 50 lies to the front of this plane. The left and right ends of the front and rear channel members 44 and 46 are disposed adjacent to each other so that the channel members together define a generally diamond shaped space therebetween.

Figure 5:
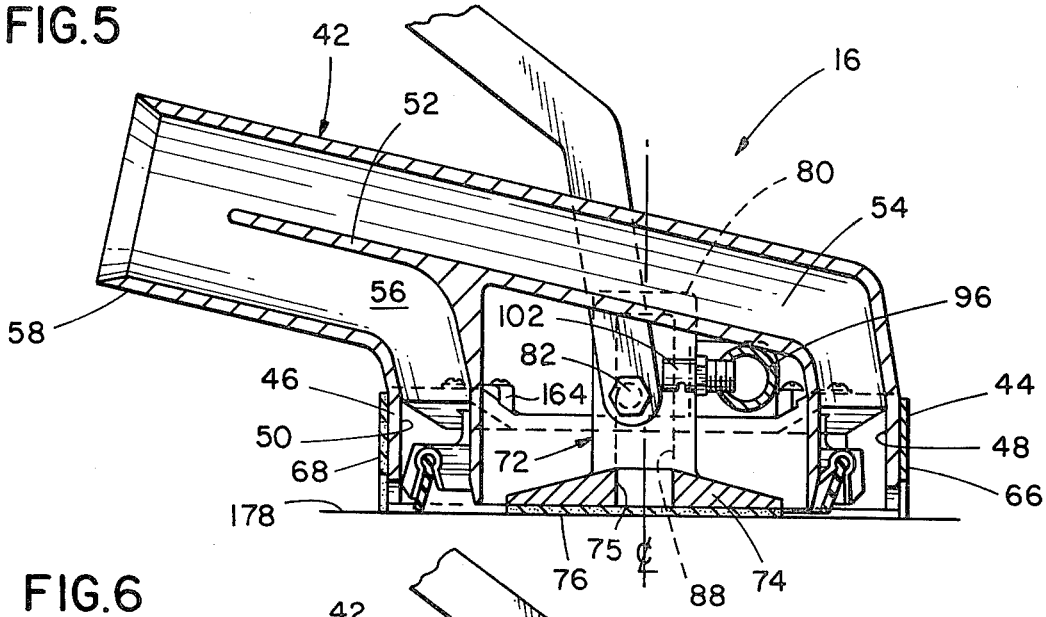
FIG. 5 is a cross-sectional view taken along line 5—5 in FIG. 2.
Figure 6:
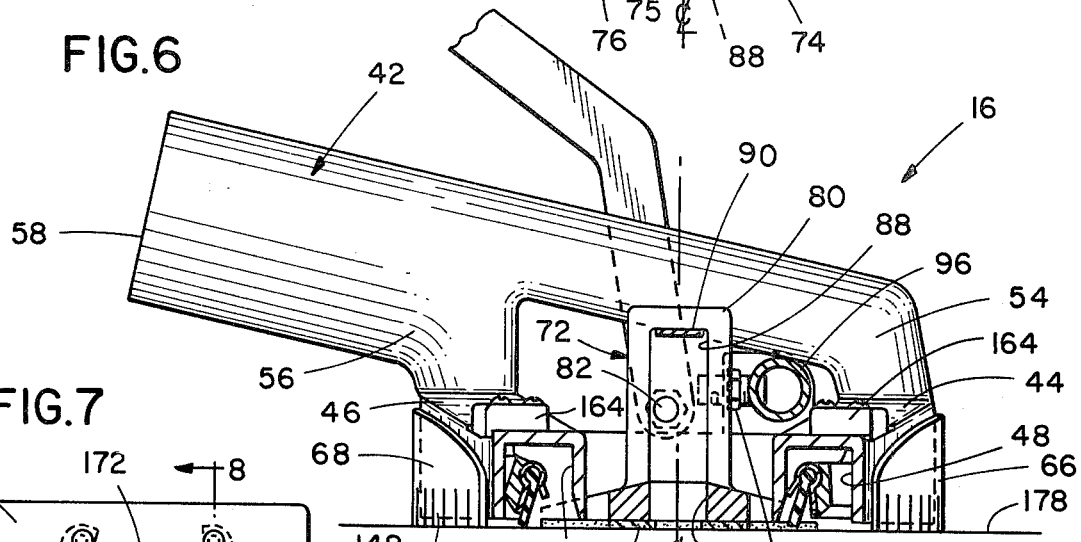
FIG. 6 is a partial cross-sectional view taken along line 6—6 in FIG. 2.

As best illustrated in FIGS. 5 and 6, a partition wall 52 divides the suction tube 42 into first and second passageways 54 and 56 which communicate with the central portions of the channel members 44 and 46, and more specifically, with the interior of the channels 48 and 50. The rear end 58 of the suction tube 42 communicates with the lower end of flexible tube 22 and is secured thereto by a conventional clamp 60. Thus, the interior of the channels 48 and 50 are exposed to the suction or vacuum source with which the metal tube 18 communicates.

A pair of central, symmetrical openings 62 and 64 are formed in the outwardly facing walls of the front and rear channel members 44 and 46 (i.e., the walls that do not face each other). Aprons 66 and 68 are secured to these outwardly facing walls of the channel members 44 and 46, respectively, and cover the openings 62 and 64, respectively. Each of the aprons has a plurality of depending, finger-like segments formed along its lower edge. These apron covered openings 62 and 64 are designed to facilitate the passage of liquid on the floor to be cleaned into the channels 48 and 50 wherein the liquid can then be drawn or sucked up into the suction tube 42 and thus up into the tubes 22 and 18.

A generally diamond-shaped scrubbing block 72 is positioned within the space between the front and rear channel members 44 and 46. The lateral dimensions of the scrubbing block 72 are such that the side edges and ends of the scrubbing block 72 do not contact the channel members. The scrubbing block is symmetrical about the longitudinal central line 47 of the head 16 and about a plane equispaced from the front and rear channel members 44 and 46 and transverse to the central longitudinal axis 47. The scrubbing block 72 includes a base 74 whose bottom surface is adapted to be in contact with the floor to be cleaned and which, as shown in FIG. 2, includes central transverse slots 75. A conventional scrubbing pad 76 may be removably secured, as for example, by a Velcro-type fastening means, to the bottom surface of the base 74 to facilitate removal of dirt on the floor. A pair of upstanding members 78 and 80 are integrally formed on the base and project upwardly therefrom. The members 78 and 80 are equi-spaced from the longitudinal central line 47 and extend upwardly beyond the upper surface of the channel members 44 and 46. The lower ends of the arms 28 of the handle 14 are pivotally attached to the ears 78 and 80 by bolts 82. As a result of this direct connection between the handle 14 and the scrubbing block 72, the operator of the tool 12 can apply direct force onto the floor to be cleaned through the handle and scrubbing block. With the scrubbing pad 76 applied to the bottom surface of the scrubbing block 72, the operator of the tool can easily clean dirt spots and other heavily soiled areas on the floor by a direct rubbing action and without need to get down on his hands and knees.

Leaf springs 84 and 86 extend between the upstanding members 78 and 80 and the ends of the channel members 44 and 46 so as to permit the entire housing 40 to "float" with respect to the scrubbing block 72. More specifically, as a result of this leaf spring connection, the housing 40 is free to plurality relatively with repect to the scrubbing block 72, and such relative motion is particularly desirable, for example, when the scrubbing block 70 is being used to remove a dirt spot from the floor.

Each of the members 78 and 80 includes outwardly facing recesses 88 which are designed to receive and retain therein the inner ends 90 of the leaf springs 84 and 86. The other, outer ends 92 of the leaf springs are attached to the upper surface of the channel members 44 and 46, adjacent to their ends, by a pluralityy of screws 94. The leaf springs 84 and 86 are bent at 95, adjacent to the ends 92, so that the ends 92 generally have a "Z" shape or configuration.

A tubular manifold 96 is mounted on the upper surface of the front channel member 44 and extends beneath the front passageway 54 of the suction tube 42. The ends of the manifold 96 are closed and supported by a pair of L-shaped brackets 98 which are, in turn, attached to the channel member 44 by screws 100. Three rearwardly directed nozzles 102 are carried by the manifold tube 96 and communicate with its interior. These nozzles 102 are designed to spray liquid such as detergent-water or soap-water cleaning solution onto the floor to be cleaned in the space between the front and rear channel members 44 and 46. As best shown in FIG. 2, a plurality of fittings 104, including a "T" fitting 106, interconnect the interior of the manifold 96 with the lower end of the tubing 30. A cap 108 closes the branch 109 of the T-fitting 106 and is removable so as to permit the manifold 96 and tubing 30 to be cleaned. Cleaning solution is therefore introduced into the manifold 96 through the tubing 30, and as noted above, flow through the tubing 30 and thus, flow through the nozzles 102 is controlled by manual actuation of the valve 34 by the operator of the tool 12.

Referring now to FIGS. 4 through 10, squeegee blade assemblies 110 and 112 are disposed in the channels 48 and 50, respectively, and extend from one end of the channels to the other. Each blade assembly 110 and 112 includes: two support members 114 which may be made from a relatively hard plastic material such as nylon, or the like; a squeegee blade 116 which may be made from rubber, or a similar plastic material; and a blade mounting clip 118 which may be made from brass or the like.

Since each of the blade assemblies 110 and 112 are structurally and functionally identical, only one such assembly will be described in detail herein. In this regard, each of the assemblies 110 and 112 includes two support members 114 that are structurally and functionally identical and that are disposed, end to end in the channel 48 or 50 so that the member 114 positioned on the right side extends from adjacent to the center line 47 to the right end of the channel and so that the member 114 positioned on the left side extends from adjacent to the center line 47 to the left hand of the channel. Each member 114 has a longitudinal groove 120 which is cut in its face 122. The bottom edge 124 of the squeegee blade 116 is designed to contact the floor to be cleaned. An enlarged bead 126 is integrally formed along the upper edge of the blade 116. The clip 118 is bent, at 128, so as to receive and retain the bead 126 although the blade 116 may pivot about the central longitudinal axis of the bead 126 relative to the clip. The distal ends 130 and 132 of the clip 118 serve as stops so as to limit the arc through which the blade 116 may pivot relative to the clip. Old blades 116 may be removed from and new blades inserted in the clips by sliding a blade longitudinally relative to the clip.

The bent portion 128 of the clip 118 is mounted within the groove 120 so that the end 132 of the clip is adjacent to the lower portion of the face 122 of the support member 114 and with the length of the end 132 being equal to the distance from the groove 120 to the lower edge 134 of the support member. The lower edge 134 is beveled, and the intersection of this bevel and the rear face 136 defines a contact edge 138.

Figure 7:
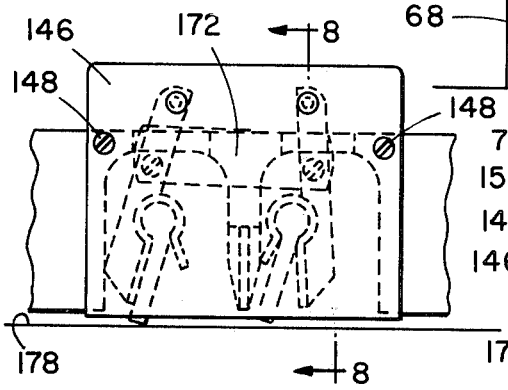
FIG. 7 is a partial end view taken along line 7—7 in FIG. 2.
Figure 9:
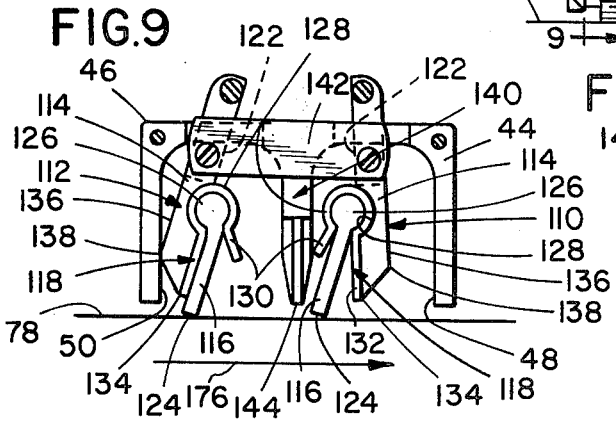
FIG. 9 is a partial cross-sectional view taken along line 9—9 in FIG. 8, and showing the squeegee blades as they would appear when the improved tool is being moved in the forward direction.
Figure 10:
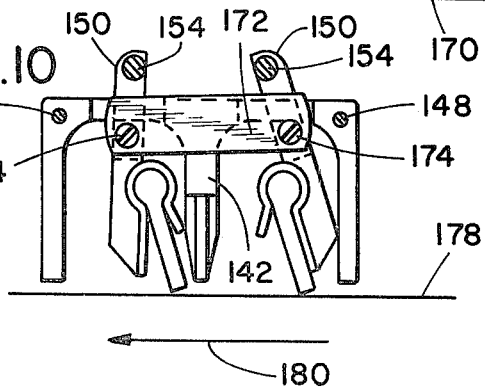
FIG. 10 is a view similar to that shown in FIG. 9 but showing the squeegee blades as they would appear when the improved tool is being moved in a rearward direction.

As noted above, the ends of the channel members 44 and 46 are disposed adjacent to each other. As best shown in FIGS. 7, 9 and 10, the channels 48 and 50 are separated at their ends by a central wall portion 140 that forms an integral part of the channel members 44 and 46. This central wall portion 140 is cut away adjacent to the upper wall of the channel members, as shown at 142, and has both sides of its lower depending end 144 beveled. Each of the adjacent pairs of ends of the channel members 44 and 46 are closed by an end plate 146 which is secured to the ends of the channel members by screws 148.

Figure 8:
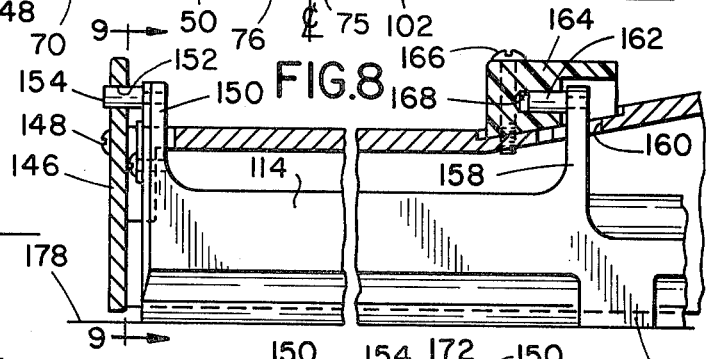
FIG. 8 is a partial cross-sectional view taken along line 8—8 in FIG. 7.

As illustrated in FIG. 8, an upwardly extending, end ear 150 is integrally formed on the outer end (i.e., the end disposed adjacent to the end plates 146) of each support member 114 and projects through an opening 152 in the upper wall of its respective channel member. A pin 154 is secured to each ear 150 and projects outwardly from the ear 150, with the axis of the pins being parallel to the central longitudinal axis of the support member 114. The pin 154 loosely fits within an aperture 156 in the end plate 146. Each of the support members 114 also has an additional upstanding integral ear 158 integrally formed between its ends, with these ears 158 being substantially equi-spaced between the central line 47 and the outer ends of the support members 114. The ears 158 project through apertures 160 formed in the upper walls of the respective channel members. Like the ears 150, a pin 162 is secured to each of the ears 158 and projects outwardly from the ear, with the axis of the pins being parallel to the longitudinal central axis of the support member 114. A mounting block 164 is secured, by screws 166, to the upper wall of the respective channel member adjacent to each of the apertures 160. Each mounting block 164 includes a recess 168, and the adjacent pin 158 loosely fits within this recess.

The loose fit between the pins 154 and the apertures 156 and between the pins 162 and the recesses 168 permits each of the support members 114 to pivot within their respective channel, relative to the end plates 146 and the mounting blocks 164 and thus relative to their respective channel member. Abutment between the contact edge 138 of the support member 114 and the forward or rearward facing wall of the channel and between the end 130 of the clip 118 and the central wall portion 140 limits the arc through which the lower ends of the support members 114 may pivot.

Depending feet 170 are integrally formed on the support members 114 adjacent the inner ears 158. The lower ends of these feet 170 extend below the lower edge 134 of the support members 114 and are adapted to sit on the floor. The feet 170 hold the lower edge 134 of the support members 114 and thus the housing 40 a relatively small distance above the floor, but do not project so far below the lower edge 134 of the support members that the lower edges 124 of the squeegee blades 116 cannot contact the floor.

As shown in FIGS. 7, 9 and 10, a link 172 interconnects each of the adjacent two ends of the support members 114. The links are disposed in the cutaway portions 142 of the channel members and are secured to the ears 150, below the pins 154, by screws 174. The links 172 cause the support members 114 to move together, in concert, as they pivot about the axis of the pins 150 and 168. More specifically and as illustrated in FIGS. 9 and 10, when the head 16 is moved in a forward direction, i.e., away from the person using the tool, and in the direction of the arrow 176 in FIG. 9, the support members 114 are pivoted relative to the channel members 44 and 46 such that the lower edge 124 of the squeegee blade 116 disposed in the rear channel 50 contacts the floor while the lower edge 124 of the squeegee blade 116 disposed in the front channel 48 is spaced slightly above the floor. This permits liquid or cleaning solution on the floor, indicated at 178, to pass beneath the lower edge 124 of the squeegee blade 116 in the front channel 48 but prevents any liquid from passing beneath the lower edge 124 of the squeegee blade 116 disposed in the rear channel 150. Conversely, when the head 16 is moved rearwardly, i.e., toward the person utilizing the tool 12 and in the direction of the 180 in FIG. 10, the lower edge 124 of the squeegee blade 116 disposed in the rear channel 50 is spaced from the floor 178 while the lower edge 124 of the squeegee blade 116 disposed in the front channel 48 is in contact with the floor. This permits liquid to pass beneath the squeegee blade in rear channel 50 while preventing any liquid from passing beneath the squeegee blade in the front channel 48. While the tool is being used, the liquid beneath the front and rear channels 48 and 50 is subject to the suction resulting from the channels being in communication with the vacuum source so that any liquid passing beneath the channels, and particularly that accumulated by the trailing squeegee blade, is sucked up and into the suction tube 42,

According to the foregoing, it should be apparent to those skilled in this art that the tool 12 affords an improved and beneficial way of cleaning and washing hard surfaces floors. Not only does the tool 12 perform the same function as the traditional wet mop, but in addition eliminates contamination of the floor by dirty water while reducing significantly the time required to clean the hard surfaced floor. It has also been found that when a relatively high CFM vacuum source, for example 90 to 95 CFM as measured at the rear end 58 of the suction tube 42 is utilized, the improved tool 12 will pick up small pieces of dirt and litter, such as paper clips, cigarette butts and the like.

It should also be obvious to those having skill in this art that various modifications and changes could be made in the improved tool 12 as described hereinabove. For example, additional feet 170 could be utilized to maintain the housing 40 above the floor. Likewise, other means could be utilized to secure the pad 76 on the bottom surface of the scrubbing block 74, and in fact, the cleaning action by the scrubbing block could be achieved by "roughening" the bottom surface of the scrubbing block so that a scrubbing pad may not always be needed. Similarly other means could be utilized to mount the support members 114 within the channels 48 and 50 so long as support members are free to pivot.

Thus since the invention disclosed herein may be embodied in other specific forms without the departing from the spirit or central characteristics thereof, the preferred embodiment described herein is therefore to be considered in all respects as illustrative and not restrictive, the scope of the invention being indicated by the appended claims, rather than by the foregoing description, and all changes which come within the meaning and equivalency of the claims are therefore intended to be embraced therein.

I claim:

1. An improved tool adapted for cleaning a hard surface floor and the like, comprising:

housing means having a front edge, a rear edge, and a bottom portion which is adapted to be positioned so as to face the floor to be cleaned;

a scrubbing block having a bottom scrubbing surface which is adapted to be positioned in surface-to-surface contact with the floor to be cleaned;

handle means having a lower end which is connected with the scrubbing block so that back and forth movement of the handle may cause corresponding back and forth movement of the scrubbing block along and over the floor to be cleaned;

means for connecting the scrubbing block with the housing means, said connection means including spring means which permit limited relative movement between the housing means and the scrubbing block;

means carried by the housing means for discharging fluid onto the floor to be cleaned;

vacuum conduit means, having one end adapted to be connected with a source of vacuum;

fluid conduit means having one end adapted to be connected with the fluid discharging means and having its other end connected with a source of fluid; and the housing means including means for removing fluid from the floor to be cleaned, with the fluid removing means being connected with the other end of the vacuum conduit means.

2. The improved cleaning tool described in claim 1 wherein the spring means includes at least one leaf spring having one end connected with the scrubbing block and having the other end connected with the housing means.

3. The improved cleaning tool described in claim 1 wherein the spring means includes two leaf springs, each having one end connected with the scrubbing block and the other end connected with the housing means, and each being disposed in a plane generally transverse to the longitudinal, front-to-rear, center line of the scrubbing block.

4. The improved cleaning tool described in claim 3 where in normal usage, the scrubbing block and the housing means are adapted to be moved, back and forth, in directions generally parallel to the longitudinal, front-to-rear center line of the housing means; wherein the means for removing fluid includes front and rear channels formed in the housing means adjacent to the front and rear edges, respectively, of the housing means; wherein the front channel has a first end and a second end; wherein the rear channel has a first end and a second end; wherein the front and rear channels are open to the bottom portion of the housing means and to the floor to be cleaned and are in communication with the vacuum conduit means; wherein front and rear squeegee blade assemblies are positioned within the front and rear channels, respectively; and wherein each squeegee blade assembly includes at least one squeegee blade whose lower edge may contact the floor to be cleaned.

5. The improved cleaning tool described in claim 4 wherein the front and rear channels are symmetrical about a plane transverse to said longitudinal center line and about a plane which includes said longitudinal center line and which is transverse to the axes of the front and rear channels; wherein the first ends of the front and rear channels are located adjacent to each other; wherein the second ends of the front and rear channels are located adjacent to each other; wherein each squeegee blade assembly includes a pair of support members that are each connected with a respective squeegee blade to support and carry the upper portion of the squeegee blade within the channel; wherein each of the pairs of support members extend substantially from the first end of its respective channel to the second end; wherein the outer ends of each of the pairs of support members are pivotably mounted on the housing so that the lower edges of the support members and their respective blades may pivotably move through an arc within their respective channels, and wherein the support members include a plurality of depending feet whose lower ends project below the bottom portion of the housing means so that the bottom portion of the housing means is disposed above the floor to be cleaned.

6. The improved cleaning tool described in claim 5 wherein a first link interconnects the outer ends of the support members adjacent to the first ends of the front and rear channels; wherein a second link interconnects the outer ends of the support members adjacent to the second ends of the front and rear channels so that the two pairs of support members move in concert with each other whereby when the scrubbing block and housing are moved in a forward direction, the lower edges of the front squeegee blades are spaced slightly above the floor to be cleaned while the lower edges of the rear squeegee blades are in contact with the floor to be cleaned and whereby when the scrubbing block and housing are moved in a rearward direction, the lower edges of the rear squeegee blades are spaced slightly above the floor to be cleaned while the other edges of front squeegee blade are in contact with the floor to be cleaned.

7. The improved cleaning tool described in claim 6 wherein the front and rear channels are symmetrical about a plane transverse to said longitudinal center line and about a plane which includes said longitudinal center line and which is transverse to the axes of the front and rear channels; wherein the scrubbing block is disposed centrally between the front and rear edges of the housing means about said lontitudinal center line; wherein the lower end of the handle includes bifurcated arms pivotably attached to the scrubbing block at points which are equi-spaced from and on each side of said lontitudinal center line; and wherein the inner ends of the support members of each of the pairs of support members are spaced apart adjacent to said longitudinal center line.

8. The improved cleaning tool described in claim 7 wherein the fluid discharging means includes nozzle means adapted to discharge fluid onto the floor to be cleaned between the front and rear edges of the housing means; and wherein the nozzle means includes a manifold and a plurality of nozzles connected with the manifold; wherein the manifold is mounted on the housing means adjacent to the front edge thereof wherein the fluid discharge means also includes a line interconnecting the manifold with a source of cleaning fluid and a valve for controlling flow through the line, the line being carried, in part, by the handle and the valve being mounted on the handle; and wherein the vacuum conduit is in part, interior of the the handle.

9. The improved cleaning tool described in claim 8 wherein a central opening is formed in the front edge of the housing means and permits fluid to pass into the front channel; wherein a central opening is formed in the rear edge of the housing means and permits fluid to pass into the rear channel; wherein aprons having a plurality of flexible depending elements are disposed over the front and rear openings, with the lower ends of the elements being in contact with the floor to be cleaned.

10. The improved cleaning tool described in claim 9 wherein the bottom surface of the scrubbing block includes a detachedly mounted abrasive pad, and wherein the bottom surface of the scrubbing block is normally in contact with the floor to be cleaned.

11. The improved cleaning tool described in claim 1 wherein the scrubbing block is positioned centrally between the front and the rear edges of the housing means; wherein the lower end of the handle includes bifurcated arms pivotably attached to the scrubbing block at points which are equi-spaced from and on each side of the longitudinal, front-to-rear center line of the scrubbing block; and wherein the connection means permits limited relative movement between the scrubbing block and the housing means and includes two leaf springs which each have a first end and a second end, with each of the leaf springs, having their first end connected with the scrubbing block and their second end connected with the housing means, and with each of the leaf springs being disposed in a plane generally transverse to said longitudinal center line.

12. The improved cleaning tool described in claim 11 wherein the fluid removing means is positioned adjacent to the front and rear edges of the housing means; and wherein the scrubbing block is disposed between the front and rear edges of the housing means and between the fluid removing means positioned adjacent thereto; and wherein in normal usage, the scrubbing block and the housing means are adapted to be moved, back and forth, in directions generally parallel to said longitudinal center line.

13. The improved tool described in claim 1 where in normal usage, the scrubbing block and the housing means are adapted to be moved, back and forth, in directions generally parallel to the longitudinal, front-to-rear center line of the housing means; wherein the means for removing fluid includes front and rear channels formed in the housing means adjacent to the front and rear edges, respectively, of the housing means; wherein the front channel has a first end and second end; wherein the rear channel has a first end and a second end; wherein the front and rear channels are open to the floor to be cleaned and are in communication with the vacuum conduit means; wherein front and rear squeegee blade assemblies are positioned within the front and rear channels, respectively; and wherein each squeegee blade assembly includes at least one squeegee blade whose lower edge may contact the floor to be cleaned.

14. The improved tool described in claim 13 wherein the front and rear channels are symmetrical about a plane transverse to said longitudinal center line and about a plane which includes said longitudinal center line and which is transverse to the axes of the first and rear channels; wherein the first ends of the front and rear channels are located adjacent to each other; and wherein the second ends of the front and rear channels are located adjacent to each other.

15. The improved tool described in claim 14 wherein each squeegee blade assembly includes a pair of support members that are connected with a respective squeegee blade so as to support and carry the upper portion of the squeegee blade within the channel, with the support members forming the pair of support members being spaced apart adjacent to said longitudinal center line; wherein each of the pairs of support members extend substantially from the first end of its respective channel to the second end; and wherein the outer ends of each of the support members are pivotably mounted on the housing means so that the lower edges of the support members, and their respective blades, may pivotably move through an arc within their respective channels.

16. The improved tool described in claim 15 wherein a first link interconnects the outer ends of the support members adjacent to the first ends of the front and rear channels; wherein a second link interconnects the outer ends of the support members adjacent to the second ends of the front and rear channels whereby when the scrubbing block and housing means are moved in a forward direction, the lower edges of the front squeegee blade are spaced slightly above the floor to be cleaned while the lower edges of the rear squeegee blade are in contact with the floor to be cleaned and whereby when the scrubbing block and housing means are moved in a rearward direction, the lower edges of the rear squeegee blade are spaced slightly above the floor to be cleaned while the lower edges of the front squeegee blades are in contact with the floor to be cleaned.

17. The improved cleaning tool described in claim 16 wherein a central opening is formed in the front edge of the housing means and permits fluid to pass into the front channel; wherein a central opening is formed in the rear edge of the housing means and permits fluid to pass into the rear channel; wherein aprons, having a plurality of flexible depending elements, are disposed over the front and rear openings, with the lower ends of the elements being in contact with the floor to be cleaned.

18. The improved cleaning tool described in claim 15 wherein the support members include depending feet whose lower ends project below the bottom portion of ths housing means so that the bottom portion of the housing means is disposed above the floor to be cleaned.

19. The improved cleaning tool described in claim 1 wherein the fluid discharging means includes nozzle means adapted to discharge fluid onto the floor to be cleaned between the front and rear edges of the housing means.

20. The improved cleaning tool described in claim 19 wherein the nozzle means includes a manifold and a plurality of nozzles connected with the manifold; wherein the manifold is mounted on the housing means adjacent to the front edge thereof; wherein the fluid discharge means also includes a line interconnecting the manifold with a source of cleaning fluid and a valve for controlling flow through the line, with the line being carried, in part, by the handle and the valve being mounted on the handle; and wherein the vacuum conduit is carried, in part, by the handle.

* * * * *